United States Patent [19]

Cunningham et al.

[11] Patent Number: 4,525,952

[45] Date of Patent: Jul. 2, 1985

[54] WINDOW LOCKING ARRANGEMENT

[75] Inventors: Philip J. Cunningham, Newark; Leon F. Slocomb, Jr., Wilmington, both of Del.

[73] Assignee: Slocomb Industries, Inc., Wilmington, Del.

[21] Appl. No.: 529,267

[22] Filed: Sep. 6, 1983

[51] Int. Cl.[3] ..... E05D 13/04

[52] U.S. Cl. ..... 49/449; 49/181; 292/340

[58] Field of Search ..... 49/449, 157, 161, 181; 292/340, DIG. 38

[56] References Cited

U.S. PATENT DOCUMENTS 652,273 6/1900 Jones ..... 49/161
3,038,747 6/1962 Popata ..... 292/DIG. 38
3,464,157 9/1969 Rodriguez ..... 49/161
3,930,336 1/1976 Ruggieri, Jr. ..... 49/161
4,144,674 3/1979 Dovman ..... 49/181 X

*Primary Examiner*—Kenneth Downey
*Attorney, Agent, or Firm*—Connolly and Hutz

[57] ABSTRACT

A window includes a hollow extruded sash and a hollow extruded frame. The arrangement includes a pair of sashes which may slide up and down to permit opening the window and which may pivot horizontally to facilitate cleaning the window. In addition to the locking means generally provided at the top wall of the lower sash, locking means are provided along the side walls to provide additional stability for the arrangement while maintaining a tighter seal. The side walls include slots into which open-faced housings are snapped for receiving the locking members.

6 Claims, 7 Drawing Figures

WINDOW LOCKING ARRANGEMENT

BACKGROUND OF THE INVENTION

Windows have long been used in various forms. One conventional arrangement, for example, is to provide a solid sash made of wood or the like for holding the glass panes. The sashes are generally mounted to a solid framework which likewise is made of wood. For security measures and other reasons, it is common to provide various types of locks for the windows. Usually the locks are located at the top of the lower sash, although it has also been known to provide side locks.

An improved form of window which has enjoyed wide-spread success is to utilize extrusion techniques to form hollow sashes and framework for the windows, and a particularly desirable variation is to arrange the sashes in such a manner that each of the upper and lower sashes may not only slide vertically to open the window but may also tilt or pivot into the house or building to facilitate cleaning the window. The disadvantage, however, with such arrangements is that by introducing such versatility with the hollow members, it is difficult to maintain an effective seal.

SUMMARY OF THE INVENTION

An object of this invention is to provide an improved window arrangement of the type which includes hollow sash and framework.

A further object of this invention is to provide such an arrangement having an improved locking mechanism which virtually eliminates air leakage.

A still further object of this invention is to provide such a locking mechanism which is particularly adapted for incorporation into extruded frame structures.

In accordance with this invention a locking mechanism is provided at each of the extruded side walls in preferably the innermost sash. Each locking mechanism includes an open-faced housing which is snapped into an appropriate slot in the extruded frame. A locking arm is selectively pivoted into and out of the housing.

THE DRAWINGS

FIG. 1 is a front elevational view partly in section of a window arrangement in accordance with this invention;

FIGS. 2 and 3 are cross-sectional views taken through FIG. 1 along the lines 2—2 and 3—3;

DETAILED DESCRIPTION

Figure 1:
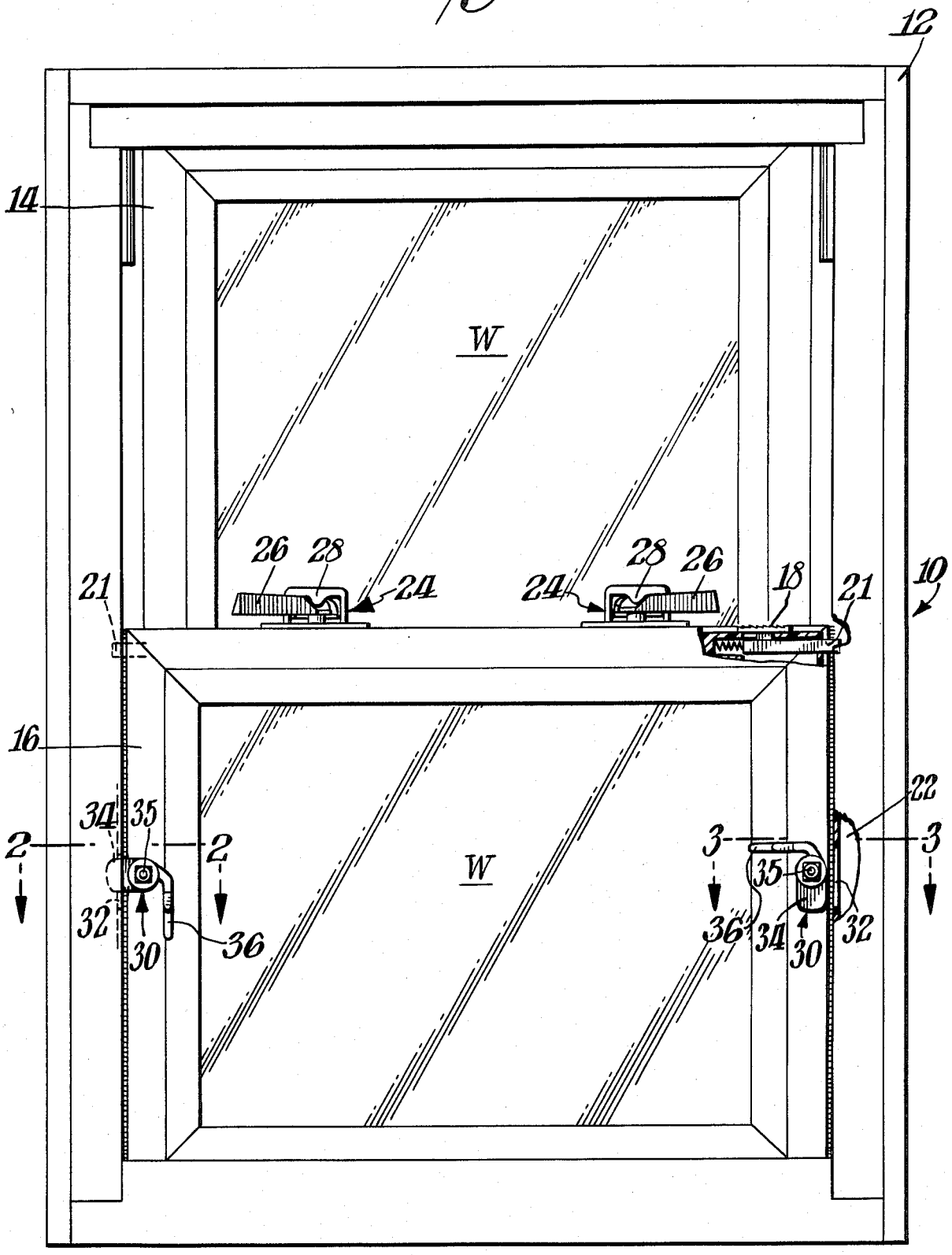

FIG. 1 shows a window arrangement 10 which includes a hollow framework generally indicated by the reference numeral 12 and an upper sash 14 and lower sash 16. Sashes 14 and 16 contain the window panes W. The sashes are mounted so as to slide vertically up and down to selectively control the amount of opening or closing of the window. The window arrangement is of the known construction wherein, for example, each sash may pivot inwardly toward the interior of the house or building or the like to facilitate cleaning of the window. As indicated, such construction is generally known, and a detailed description is not necessary for an understanding of the invention. In general, the arrangement includes a pair of slide members 18 which are spring biassed to a closed position whereby tongues 20 would enter an extended exposed slot 22 in the hollow interior of frame 12. When the tongues 20 are in slots 22, tilting action is prevented. By moving slides 18 toward each other, however, the spring action is overcome, and tongues 20 are withdrawn from frame 12 whereby a respective sash may pivot inwardly about pins at the lower end thereof, not shown. Upper sash 14 likewise includes the same arrangement of slide members, tongues and pins as in the lower sash, although such members are not shown.

With conventional window arrangements of the above type, a locking mechanism is generally provided to reliably lock elements on the upper edge of lower sash 16 with elements at the lower edge of upper sash 14. Depending on the size of the window, a single or double locking arrangement is conventionally provided. As illustrated in FIG. 1, two such locking mechanisms 24, 24 are illustrated which include a rotatable locking arm 26 on lower sash 16. Arms 26, 26 rotate into and out of locking engagement with stationary locking mount 28 secured to the lower end of upper sash 14.

Figure 2:
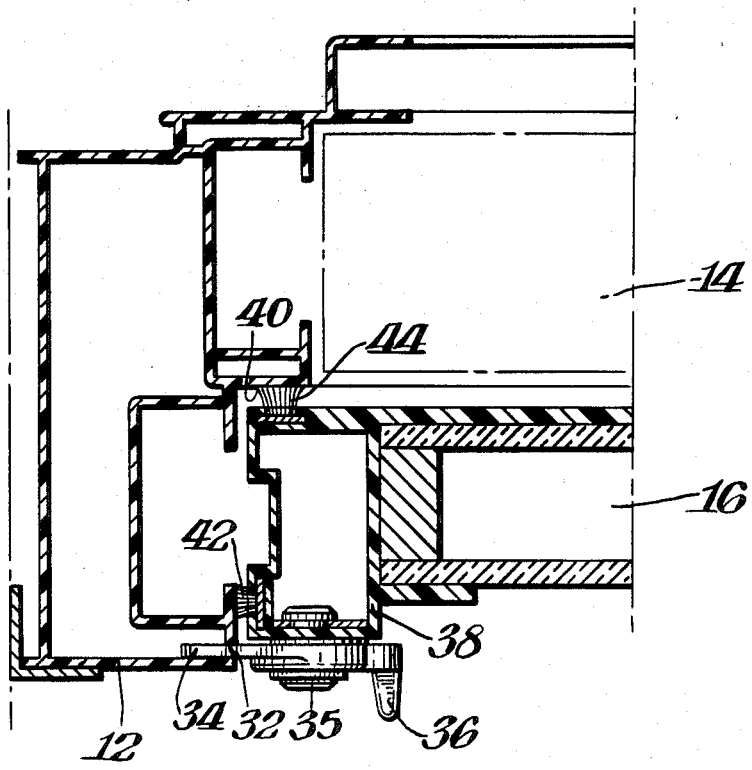
Figure 3:
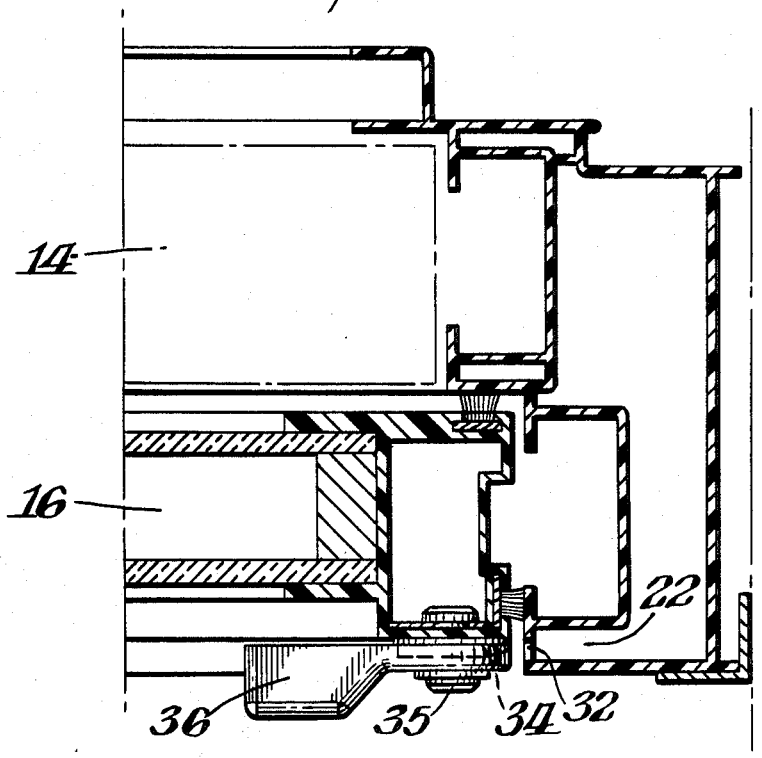
Figure 4:
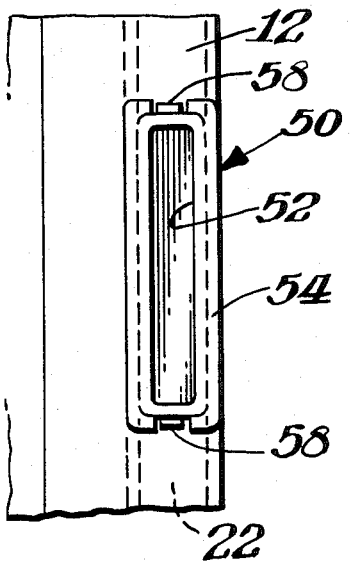
FIG. 4 is a front elevation view showing a housing snapped into the window arrangement of FIGS. 1–3.
Figure 5:
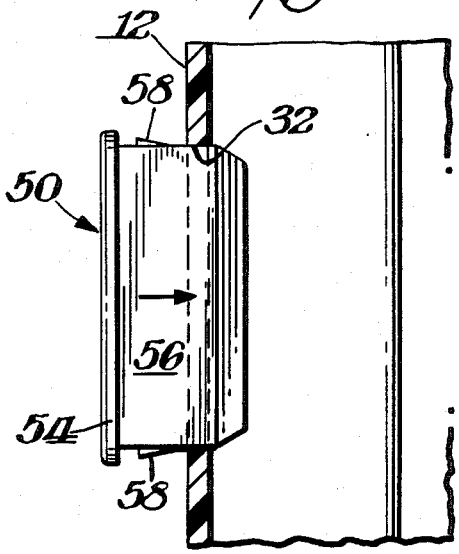
FIG. 5 is a side elevation view, partly in section, showing the housing of FIG. 4 as it is being snapped into the window arrangement.

The present invention is directed to the type of window frames and sashes which are formed from hollow members such as by extruding a suitable metal or plastic. FIGS. 2–3, for example, illustrate in cross section the hollow channels formed by this extrusion process. A disadvantage with window arrangements of this type resides in the lack of desired stability along the sides of the windows. Such lack of stability manifests itself by the sides of the sash sometimes being out of contact with the appropriate flanges on the frame 12. As a result, it is difficult to effectively seal the window thus leading to drafts and energy loss.

The present invention is intended to overcome the above disadvantages resulting from lack of stability in a uniquely simplified manner which would thus not appreciably add to the costs of the window arrangement or render the window arrangement difficult to operate. This is accomplished by providing a locking mechanism 30 at each side of the innermost sash which is illustrated in FIG. 1 as being the lower sash. Because an extruded framework is utilized, advantage is taken of the hollow interior of the framework for constructing the locking mechanism 30. Specifically, a slot 32 is formed at opposite sides of hollow frame 12 in communication with channel 22. Each sash has mounted thereto a locking arm 34 which is rotatably mounted on pin 35 at a location remote from integral handle member 36. The parts of locking mechanism 30 are dimensioned so that as shown in the left hand portion of FIG. 1, handle member 36 is in a vertical orientation coplanar with shoulder 38 of lower sash 16. As illustrated, handle member 36 is offset so as to be 90° displaced from locking arm 35. When in the locking position illustrated in the left hand portion of FIG. 1 and illustrated in FIG. 2, lower sash 16 is urged into and maintained in contact with rim 40 of frame 12. This in itself would assure a good seal between the lower sash and frame. Moreover, since there is an overlap between the upper and lower sashes, the tendency for the upper sash to vibrate or be unstable is minimized by the firm securement of lower sash 16 which not only presses against frame 12 but also presses against the upper sash 14. To enhance the sealability of the arrangement, sealing strips 42, 44 are provided as best illustrated in FIGS. 2–3 around the perimeter of upper sash 14 and along the sides of lower sash 16. The top end of upper sash 14 fits in a channel or header. The top end of upper sash 14 is thus captured on three sides for sealing purposes and added stability. The lower sash 16 in turn is effectively sealed and stable by means of the locking mechanisms. Since lower sash 16 is coupled to the bottom of upper sash 14 in the locked condition, the sealability of upper sash 14 is complete.

The sealing features represents a distinct aspect of this invention. The test standards for windows 56 inches by 90 inches for AAMA specifications for A2 type windows permit air infiltration at 25 mph up to 0.5 cfm per perimeter foot of crack length. With the inventive arrangement, however, infiltration was only 0.07 cfm which is markedly superior performance compared to the test standard. Moreover, in actual practice, windows would be substantially smaller than the test standard which should lower the air infiltration even more.

When locking mechanisms 30 are in their locking position, the locking mechanisms not only have the advantage of maintaining a proper seal, but also serve to further prevent intrusion or unauthorized opening from the outside. In this regard, locking mechanisms 30 prevent any sliding movement of lower sash 16 because of the engagement of locking arms 34 in slots 32. If desired, additional slots similar to slots 32 may be provided at other locations in frame 12 so that lower sash 16 may be raised and then locked in place.

Although a particular type of locking arrangement 30 has been illustrated, other forms such as spring biassed pins may also be utilized within the broad concepts of this invention. These other forms include a screw-in device which draws the insert frame into closer alignment to the master frame by means, for example, of a knurled knob. The illustrated arrangement, however, is particularly desirable in that it makes use of the hollow formation resulting from the extruded members with minimal difficulty. As also previously indicated, various materials such as plastic, metal or combinations thereof may be used for forming the hollow members.

Figure 6:
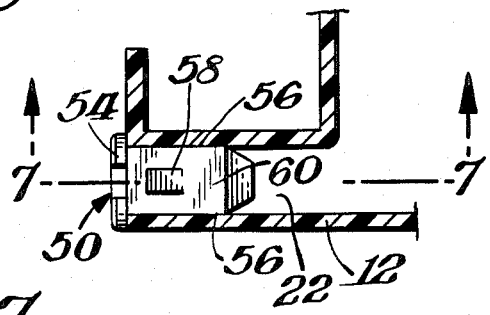
FIG. 6 is a cross-section view showing the housing of FIG. 4 mounted in place.
Figure 7:
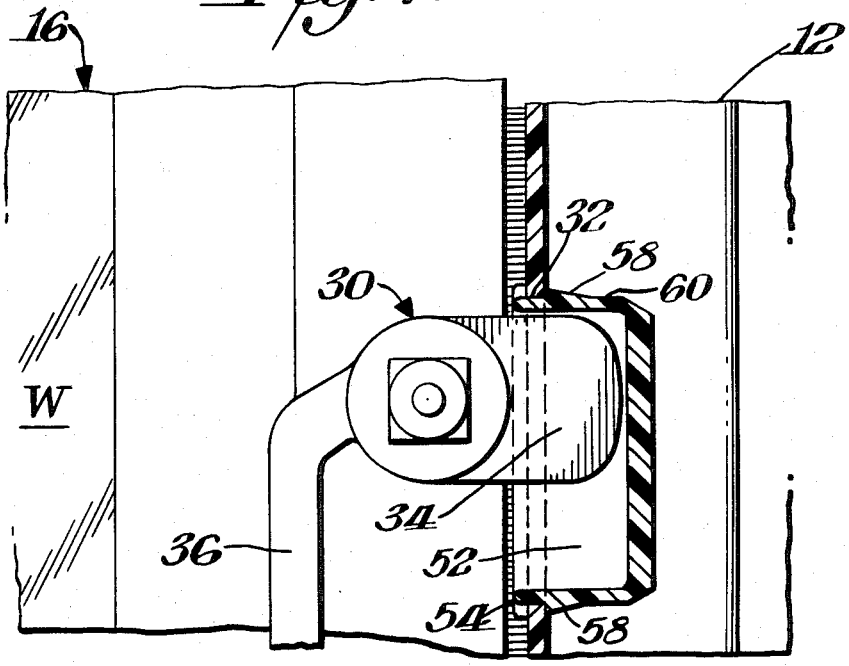
FIG. 7 is a cross-sectional view taken through FIG. 6 along the line 7—7 and showing the locking mechanism in the locked condition.

FIGS. 4–7 show a preferred practice of this invention wherein a housing 50 is snapped into each slot 32 to avoid wear and damage to extruded frame 12 should locking arms 34 be in direct contact with the edges of slots 32 in frame 12. Housing 50 is completely closed except for one open face 52. An elongated flange 54 extends along each edge of open face 52 and outwardly beyond the side walls 56 of housing 50. A wedge or tapered formation 58 is formed in each end wall 60 of housing 50. Side walls 56 are spaced apart from each other by the width of channel 22 (FIG. 6). Additionally the upper edge of wedge 58 is spaced from flanges 54 by a distance substantially equal to the thickness of the wall of frame 12 in which slot 32 is formed (FIG. 7). Housing 50 is formed of a suitable plastic material so that it may be inserted into channel 22 through slot 32 until flanges 54 abut against frame 12 at which time the frame wall is captured between flanges 54 and wedges 58 and housing 50 is thereby locked in place. Open face 52 and the interior of housing 50 are suitably dimensioned to receive locking arm 34 (FIG. 7).

What is claimed is:

1. In a window arrangement of the type having a pair of sashes to which the window panes are mounted with the sashes being vertically slidable to selectively control the amount of window opening, locking means being provided for locking juxtaposed edges of the sashes to each other, the sashes being formed from hollow members and being mounted to a hollow frame in such a manner that each sash may pivot inwardly to facilitate cleaning of the window, the improvement being a locking member being provided on each side on one of said sashes, at least one slot being formed in each side of said hollow frame corresponding in size and position to a respective locking member, means for mounting each locking member for selective engagement in a respective slot to thereby m maintain a seal of the sash, said locking means comprising a pair of locking mechanisms for locking said lower sash to said upper sash, housing being mounted in each of said slots into which said locking member may be selectively moved, securing means securing said housing in its respective slot, said securing means including flange means at the open face of said housing, and wedge members on the end walls of said housing spaced from said flange means to capture the wall of the slot therebetween.

2. The arrangement of claim 1 wherein sealing strips are provided on said sashes.

3. The arrangement of claim 2 wherein said sashes and said frame are extruded members.

4. The arrangement of claim 1 wherein each of said locking members includes a locking arm pivotally mounted to its sash and a handle member secured to said locking arm and displaced therefrom.

5. The arrangement of claim 4 wherein said handle member is displaced 90° from said locking arm.

6. The arrangement of claim 5 wherein said locking members are located on said lower sash and said upper sash is free of any side locking members.

* * * * *